US009908162B2

(12) United States Patent
McIsaac

(10) Patent No.: US 9,908,162 B2
(45) Date of Patent: Mar. 6, 2018

(54) AUTOMATED CUT AND ROLL MACHINE BRAKE ASSEMBLY

(71) Applicant: Ideal Products of Canada, Edmonton (CA)

(72) Inventor: Frank McIsaac, Beaumont (CA)

(73) Assignee: IDEAL PRODUCTS OF CANADA, Edmonton (CA)

( * ) Notice: Subject to any disclaimer, the term of this patent is extended or adjusted under 35 U.S.C. 154(b) by 387 days.

(21) Appl. No.: 14/556,635

(22) Filed: Dec. 1, 2014

(65) Prior Publication Data

US 2015/0151346 A1 Jun. 4, 2015

Related U.S. Application Data

(60) Provisional application No. 61/911,030, filed on Dec. 3, 2013.

(51) Int. Cl.
*B21D 5/04* (2006.01)
*B21D 19/08* (2006.01)
*B21D 5/02* (2006.01)

(52) U.S. Cl.
CPC ..... *B21D 5/042* (2013.01); *B21D 19/08* (2013.01); *B21D 5/02* (2013.01); *B21D 5/04* (2013.01)

(58) Field of Classification Search
CPC ..... B21D 5/02; B21D 5/04; B21D 5/042
USPC ..... 72/312, 313, 314, 315, 319, 320, 321, 72/446, 448, 452.4, 452.6
See application file for complete search history.

(56) References Cited

U.S. PATENT DOCUMENTS

| | | | | |
|---|---|---|---|---|
| 2,336,105 | A * | 12/1943 | Lilja | B21D 39/02 72/314 |
| 3,948,074 | A * | 4/1976 | Stalzer | B21D 5/042 72/312 |
| 4,901,555 | A | 2/1990 | Shimoichi | |
| 5,927,135 | A * | 7/1999 | Kutschker | B21D 5/04 72/319 |
| 2002/0124621 | A1* | 9/2002 | Clark | B21D 5/04 72/319 |
| 2003/0159490 | A1* | 8/2003 | Stalzer | B21D 5/04 72/319 |
| 2004/0060337 | A1* | 4/2004 | Break | B21D 5/04 72/319 |

(Continued)

OTHER PUBLICATIONS

Office Action mailed in corresponding Canadian Patent Application No. 2,873,190 dated Mar. 11, 2016, consisting of 4 pp.

(Continued)

*Primary Examiner* — Teresa M Ekiert
*Assistant Examiner* — Gregory Swiatocha
(74) *Attorney, Agent, or Firm* — Volpe and Koenig, P.C.

(57) ABSTRACT

A brake assembly machine for forming a hem in sheet metal has a top bar and a bottom bar opposite the top bar. The top bar and the bottom bar can move towards one another to hold sheet metal therebetween. The brake assembly machine also has an angle foot movable to a proximity of a bending bar that moves about a bending bar axis and includes a bending face. As the bending bar moves about the bending bar axis, the bending face of the bending bar can move closer to the angle foot and before the bending bar bending face contacts the angle foot, the angle foot moves to avoid contact with the bending bar.

19 Claims, 25 Drawing Sheets

(56) References Cited

U.S. PATENT DOCUMENTS

2005/0011247 A1* 1/2005 Jacobsen ..... B21D 5/0209
72/389.8

OTHER PUBLICATIONS

Examination Report mailed in corresponding Canadian Patent Application No. 2,873,190 dated Jan. 13, 2017, consisting of 4 pp.

* cited by examiner

AUTOMATED CUT AND ROLL MACHINE BRAKE ASSEMBLY

CROSS REFERENCE TO RELATED APPLICATION

This application claims the benefit of U.S. provisional application 61/911,030 with a filing date of Dec. 3, 2013 which is incorporated by reference as if fully set forth.

BACKGROUND

Sheet metal edges can be sharp and unsafe to handle, causing potential damage to people or other material in their proximity. One way to prevent these edges from causing damage is to bend the end of the sheet metal back against itself in a way that creates a smoother rounded edge or hem. For example, in FIG. 1, a sheet metal piece 80 is shown in cross section with sharp edges 82. In order to present a smooth rounded hem 84 to improve safety during handling and in application, the sheet metal piece end has been bent back on itself to form what is called a hem 84.

Hems like this are sometimes formed by a brake press that bends the sheet metal end onto itself between two opposed die heads. In practice, this is a challenging operation that requires that the sheet metal be held firmly in place while the die heads form the hem. Further, the initial bending operation may be done by driving a punch into a die, then completing the bend between the opposed die heads. Either approach requires multiple steps and multiple manipulations of the sheet metal, and thus makes it difficult to use a continuous sheet that can be fed through a machine. The machine described herein improves on the known methods.

SUMMARY

A brake assembly machine for forming a hem in sheet metal has a top bar and a bottom bar opposite the top bar. The top bar and the bottom bar can move towards one another to hold sheet metal therebetween. The brake assembly machine also has an angle foot movable to a proximity of a bending bar that includes a bending face. As the bending bar and bending face move about a bending bar axis axis, the bending face of the bending bar moves closer to the angle foot and before the bending bar bending face contacts the angle foot, the angle foot moves to avoid contact with the bending bar.

BRIEF DESCRIPTION OF THE DRAWING(S)

DETAILED DESCRIPTION OF THE PREFERRED EMBODIMENT(S)

Figure 6:
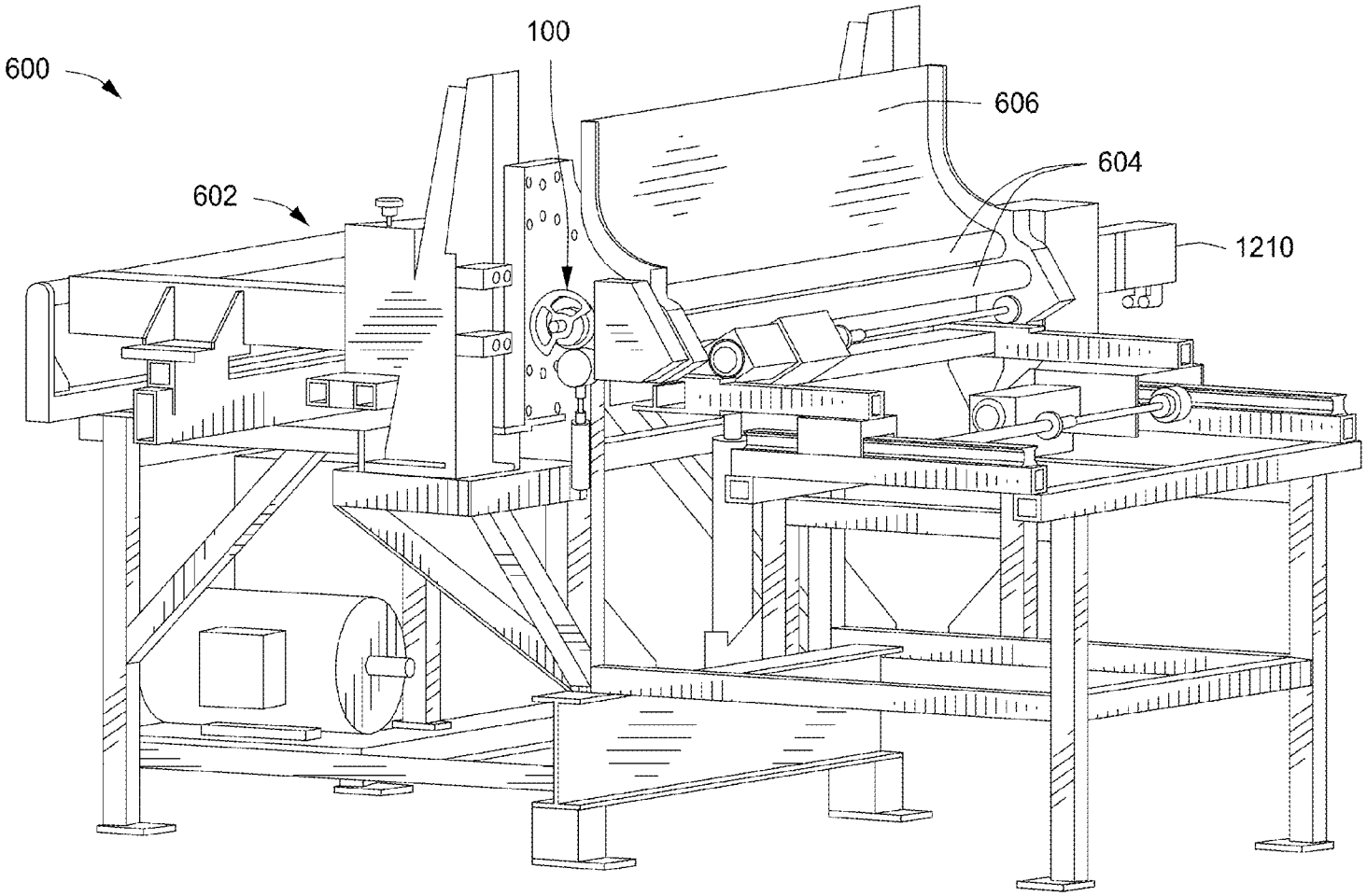
FIG. 6 is an isometric view of an alternate embodiment of a brake assembly according to embodiments of the present invention within an automated cut and roll machine.
Figure 7:
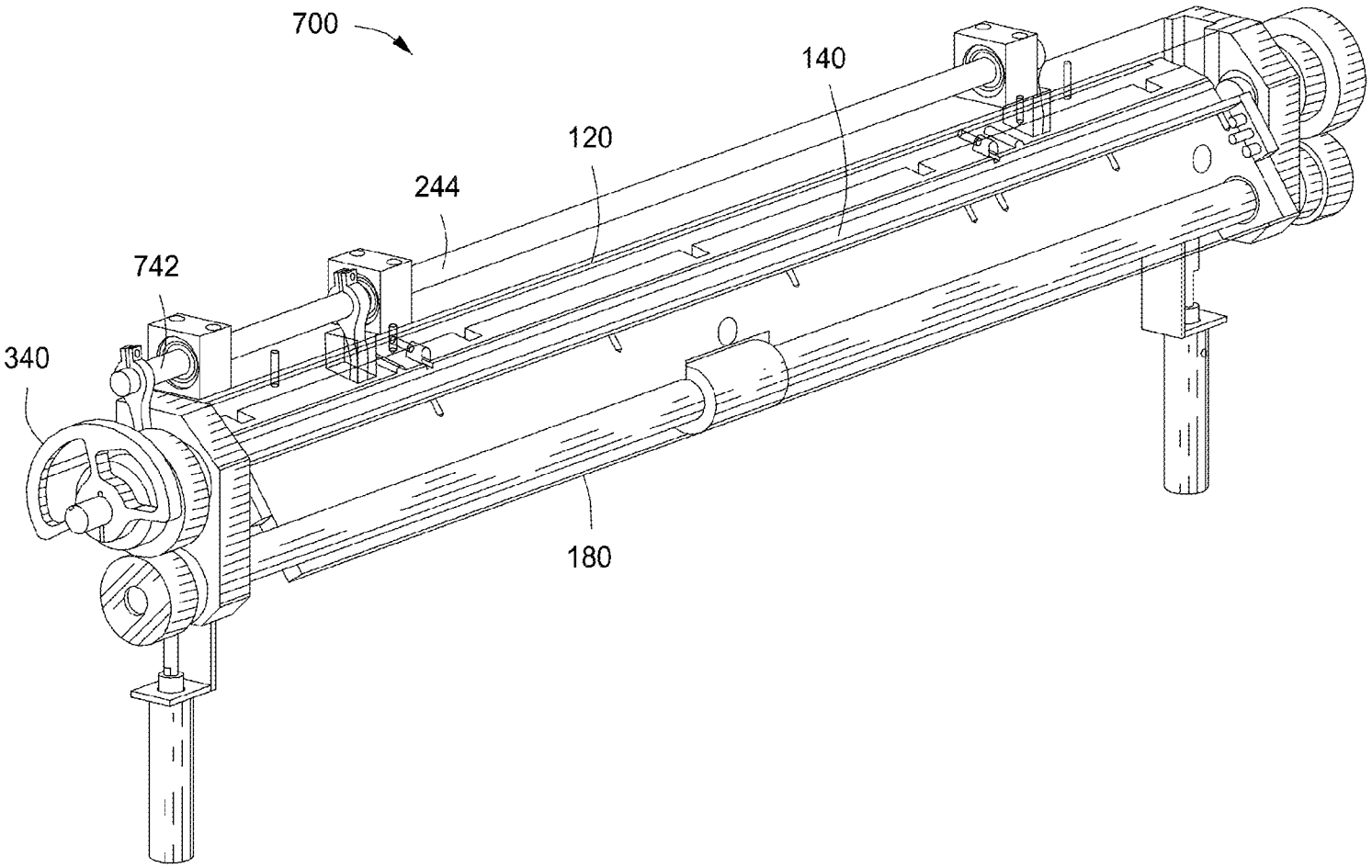
FIG. 7 is an isometric view of an alternate embodiment of a brake assembly machine according to embodiments of the present invention.
Figure 8:
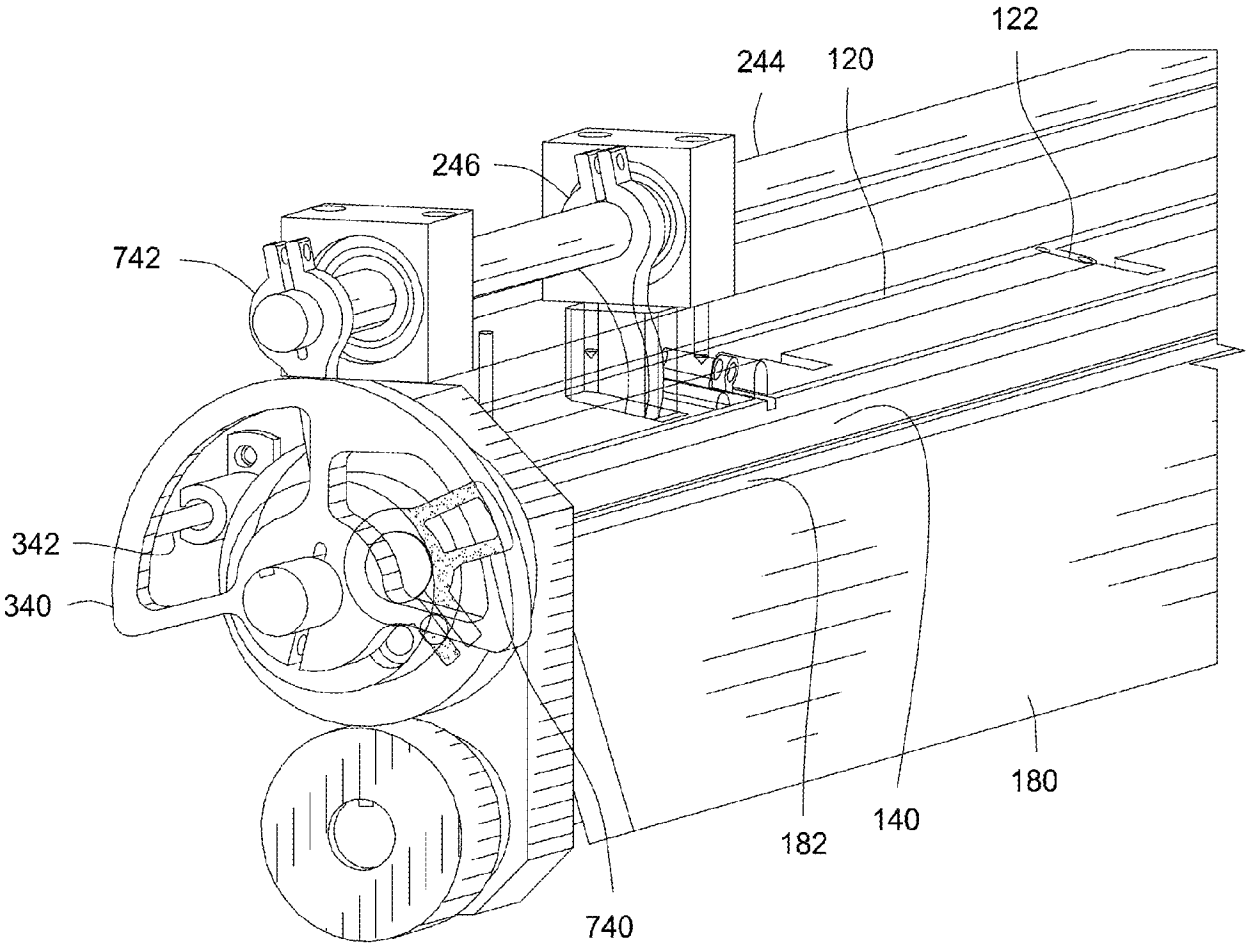
FIG. 8 is an isometric view of an alternate embodiment of a brake assembly machine according to embodiments of the present invention.
Figure 9:
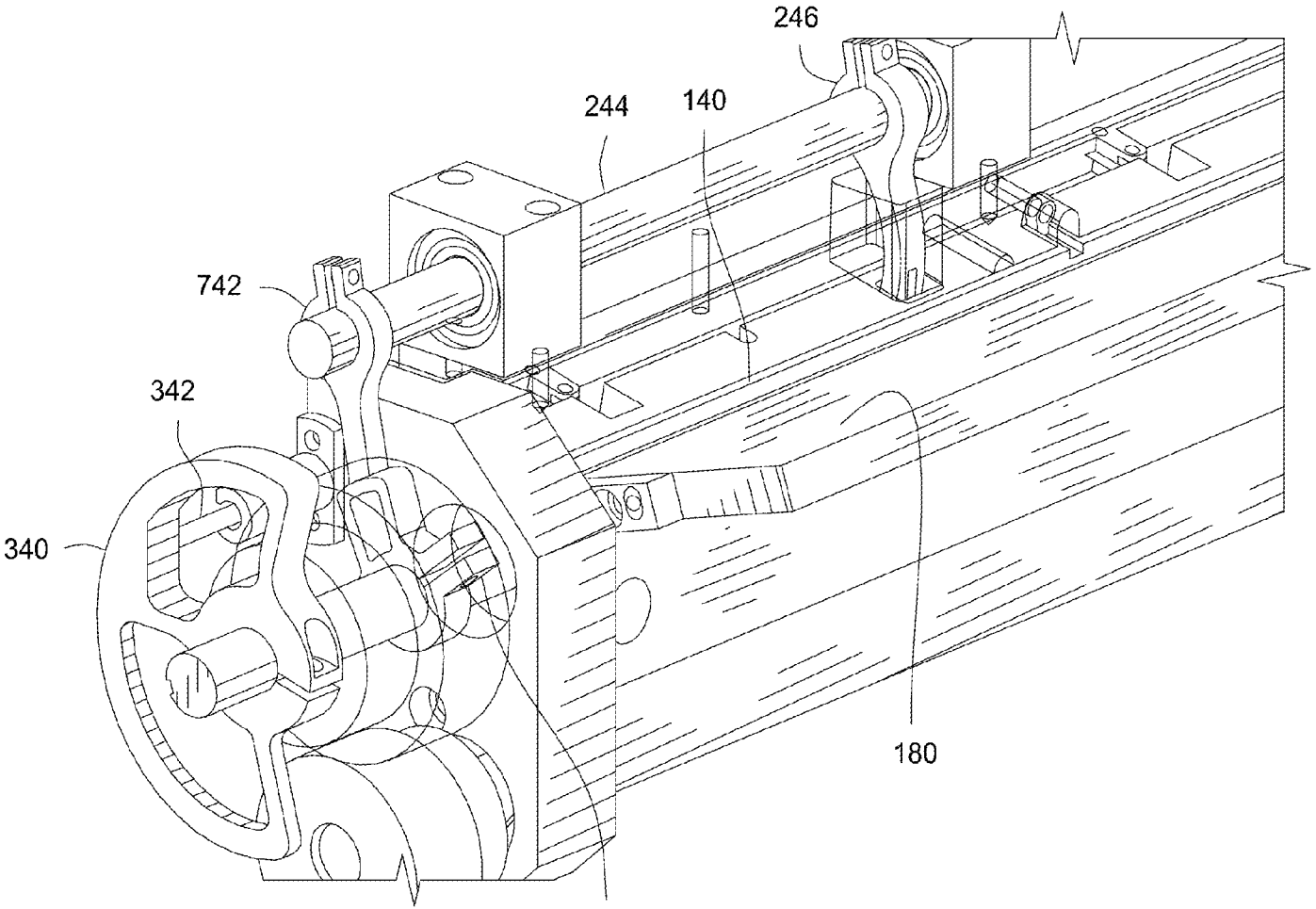
FIG. 9 is an isometric view of an alternate embodiment of a brake assembly machine according to embodiments of the present invention.
Figure 10:
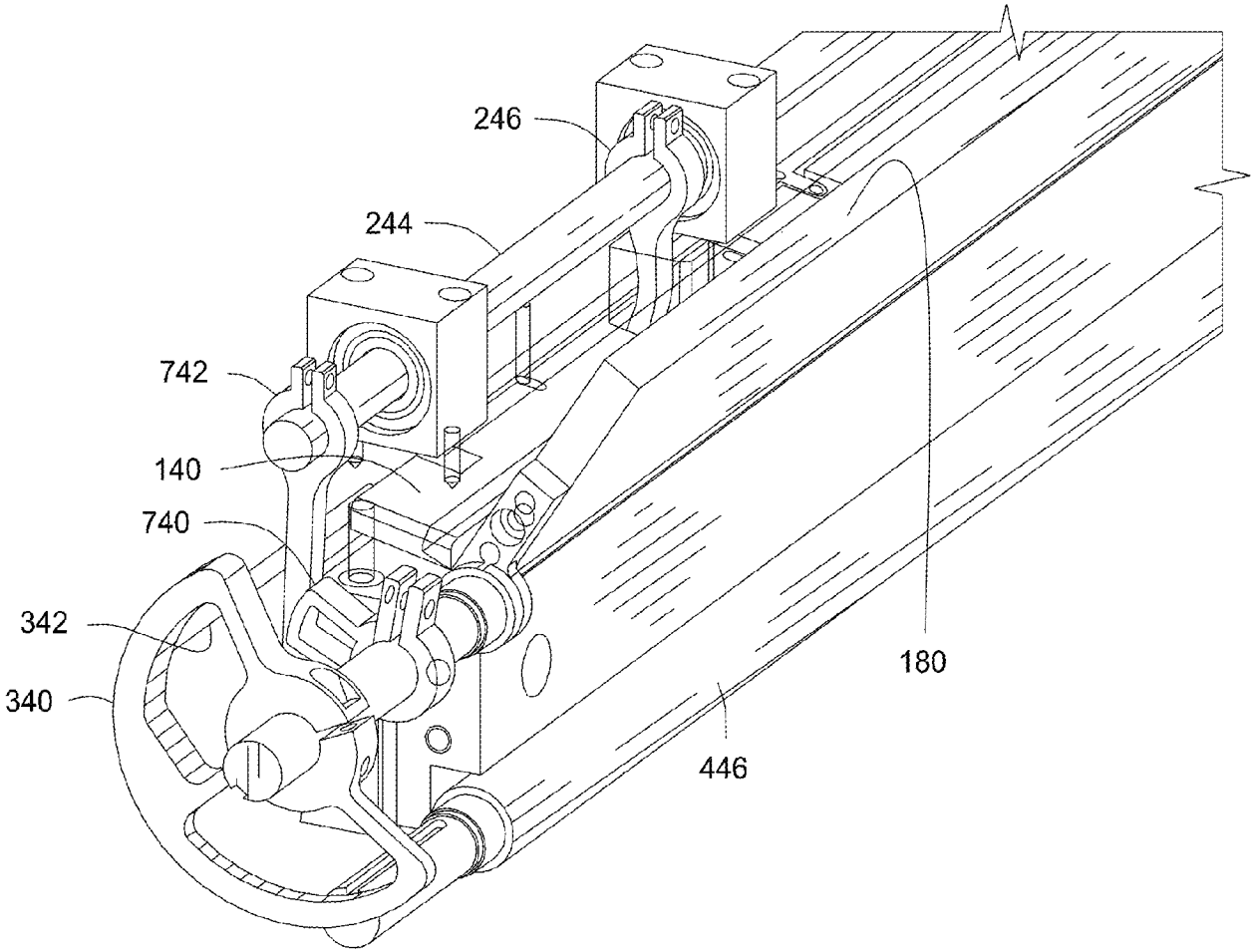
FIG. 10 is an isometric view of an alternate embodiment of a brake assembly machine according to embodiments of the present invention.
Figure 11:
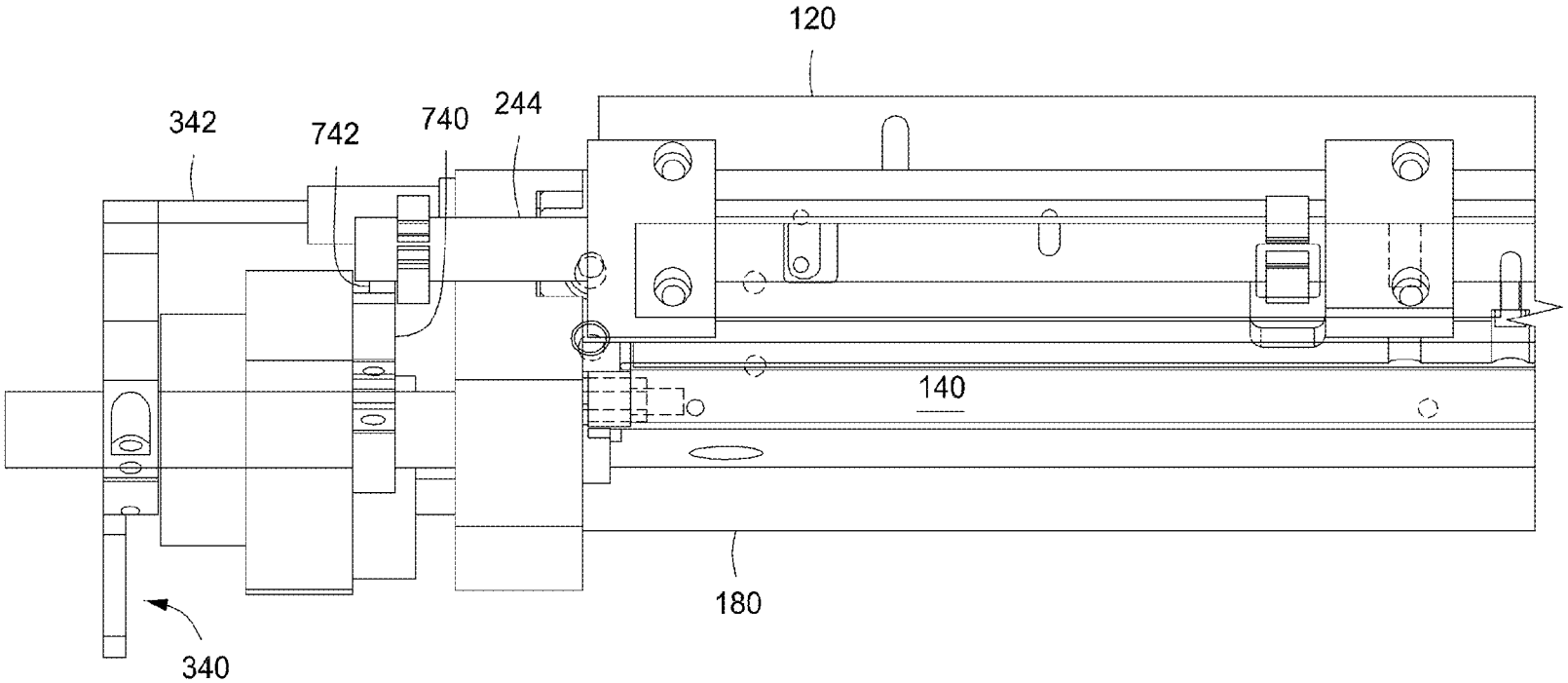
FIG. 11 is a bottom view of an alternate embodiment of a brake assembly machine according to embodiments of the present invention.

An automated cut and roll machine 600 (an overview of the machine is shown in FIG. 6, described below) generally takes sheet metal, cuts it to a length, and rolls it to a desired radius by forming the sheet into an open cylindrical shape. Adding a brake assembly into a cut and roll machine allows for the formation of the safety hem mentioned above and will be further described herein. Although this disclosure focuses on the brake assembly, its role in the broader context of the automated cut and roll machine should be understood.

Figure 1:
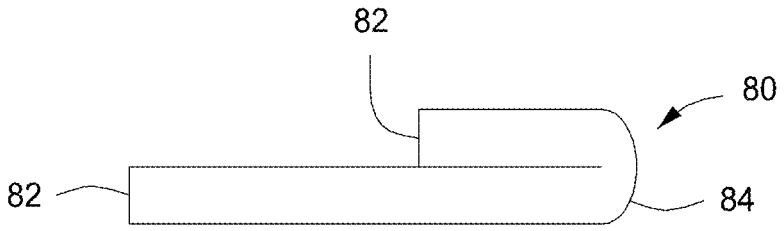
FIG. 1 shows a simple folded hem in sheet metal.
Figure 2A:
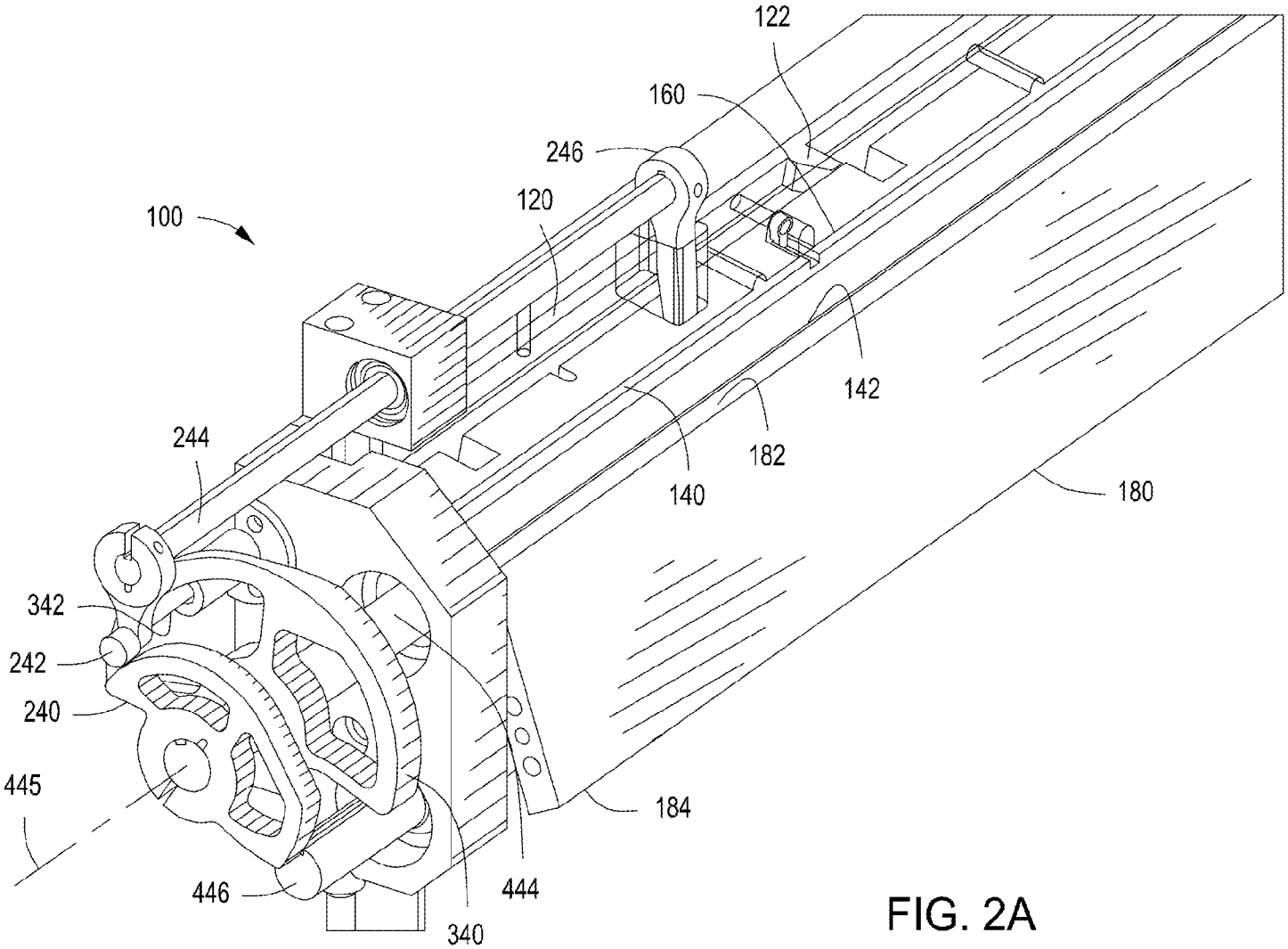
FIG. 2A is an isometric view of a brake assembly machine according to embodiments of the present invention.
Figure 2B:
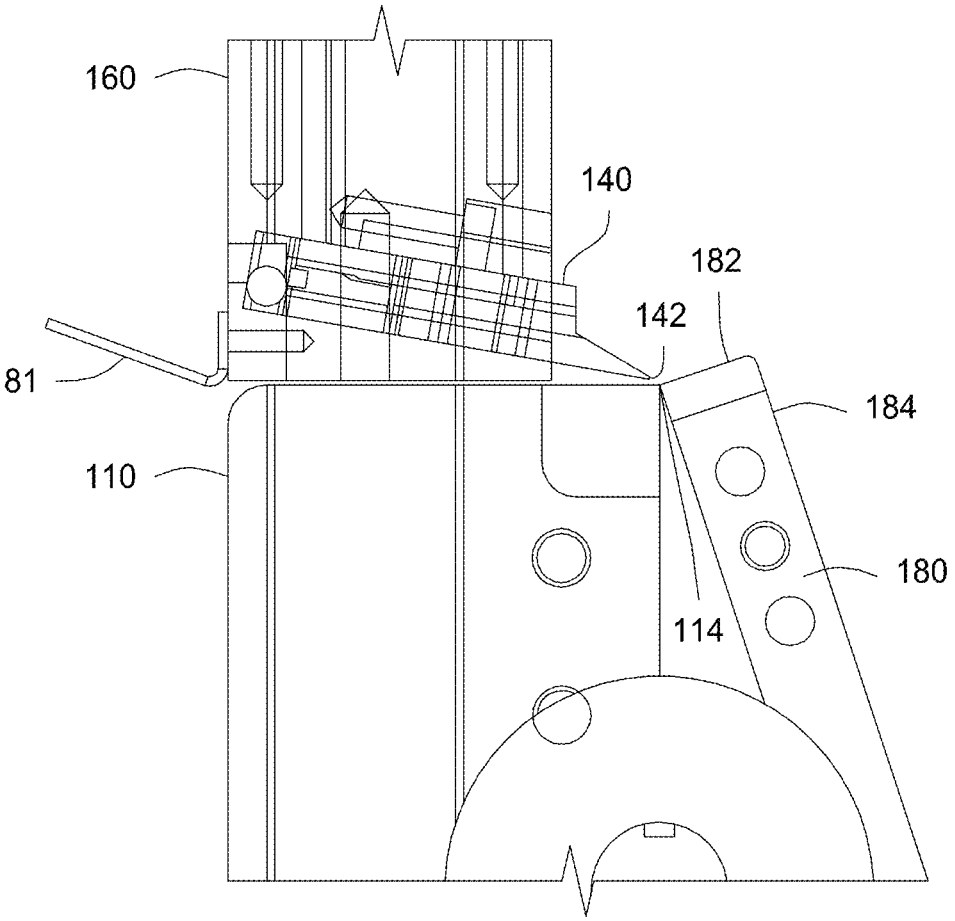
FIG. 2B is a side cross sectional view through the brake assembly of FIG. 2A.
Figure 2C:
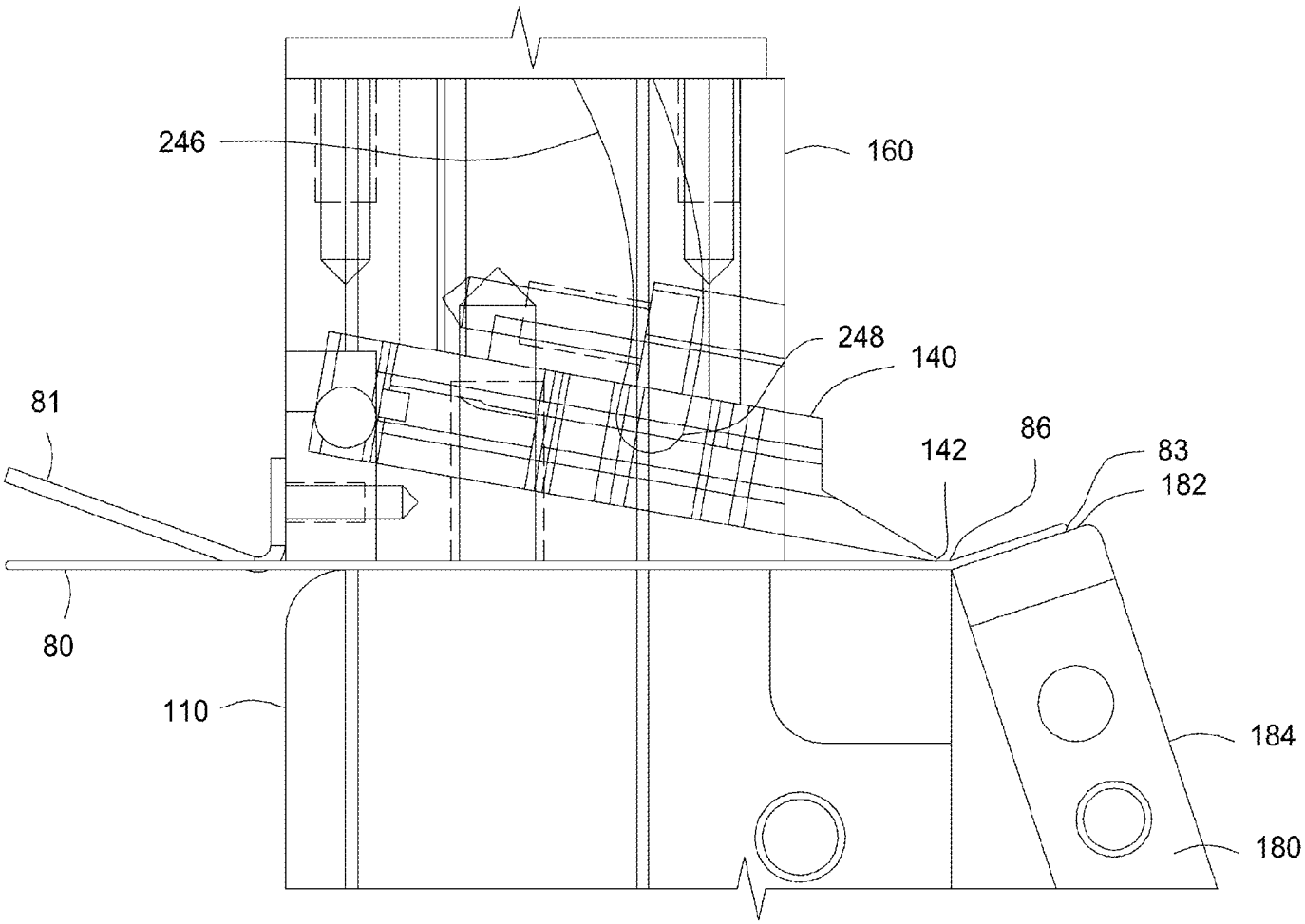
FIG. 2C is a side cross sectional view through the brake assembly of FIG. 2A showing sheet metal in the process of being formed into a hem.
Figure 12:
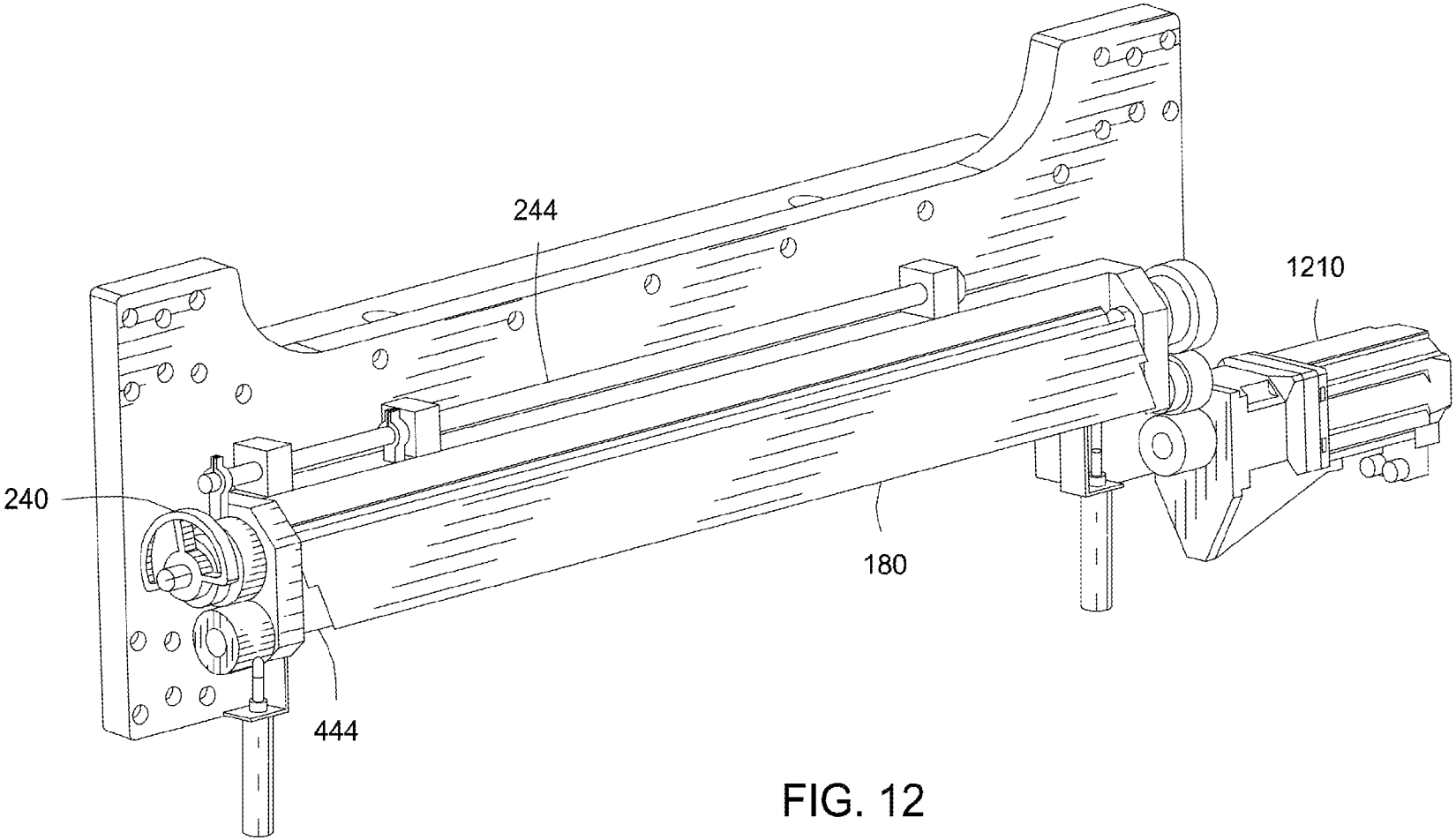
FIG. 12 is a cutaway isometric view of an alternate embodiment of a brake assembly machine according to embodiments of the present invention.

Considering FIG. 2A as an overview of the brake assembly machine 100, the angle foot cam 240 and push rod cam 340 move with the counterclockwise motion (as viewed from the left end as drawn) of the main shaft 444 that is driven by a motor (1210 FIGS. 6 and 12). The push rod cam 340 moves a spring-biased push rod 342 that pushes the backer bar 120 to the side and out of the way of the angle foot 140. The angle foot 140 extends and withdraws (more on this motion later) through the action of the angle foot cam 240 that acts on the angle foot cam follower 242, which turns the angle foot shaft 244 that operates an angle foot actuator 246, that extends and withdraws the angle foot 140 depending on its position in its rotational cycle.

The bend bar 180 moves about a bending bar axis 445 synonymous (i.e., collinear) with the axis of the main shaft 444 due to its attachment to the main shaft 444. A torque transfer shaft 446 transfers torque from one side of the shaft 444 to the other through a coupling that joins the two shafts 444, 446. This minimizes twisting of the bend bar 180 during its motion.

FIGS. 2A-5D show a progression through a cycle in the brake assembly as it forms a hem in sheet metal.

As shown in FIGS. 2A-2D, which are views at a similar step in the brake assembly operation, sheet metal 80 (shown only in FIG. 2C for simplicity sake) is fed into the brake assembly machine 100 under a material deflector 81 that guides the sheet metal into the machine 100, over a bottom bar 110 and under an angle foot 140 and a top bar 160, which is shown as transparent in FIG. 2A to aid in seeing the other parts. The sheet metal 80 is fed until its leading edge 83 extends along the bend face 182 of a bend bar 180. In looking to form a half inch seam in the sheet metal with a ⅝ inch thick bend bar face 182, the sheet metal 80 would preferably be fed to within ⅛ inch of the bend bar face 184. The bend bar face 182 may be replaceable in order to allow for replacement of just the face 182 after excessive wear. Although FIGS. 2A-2D show the bend bar 180 partially through its upwards swing, the bend face 182 of the bend bar 180 will normally be level with the bottom bar 110 as the sheet metal 80 is first secured in place.

The sheet metal 80 is secured in place between the top bar 160 and the bottom bar 110 as the top bar 160 descends to place pressure against the sheet metal 80. With the sheet metal 80 secured in place, the point 142 of the angle foot 140 contacts the sheet metal 80 above an adjustable gap 114 between the bend bar 180 and bottom bar 110, near the point where the sheet metal 80 will bend. As the bend bar 180 bends around the gap 114, a bend 86 in the sheet metal 80 forms around the angle bar point 142.

Figure 2D:
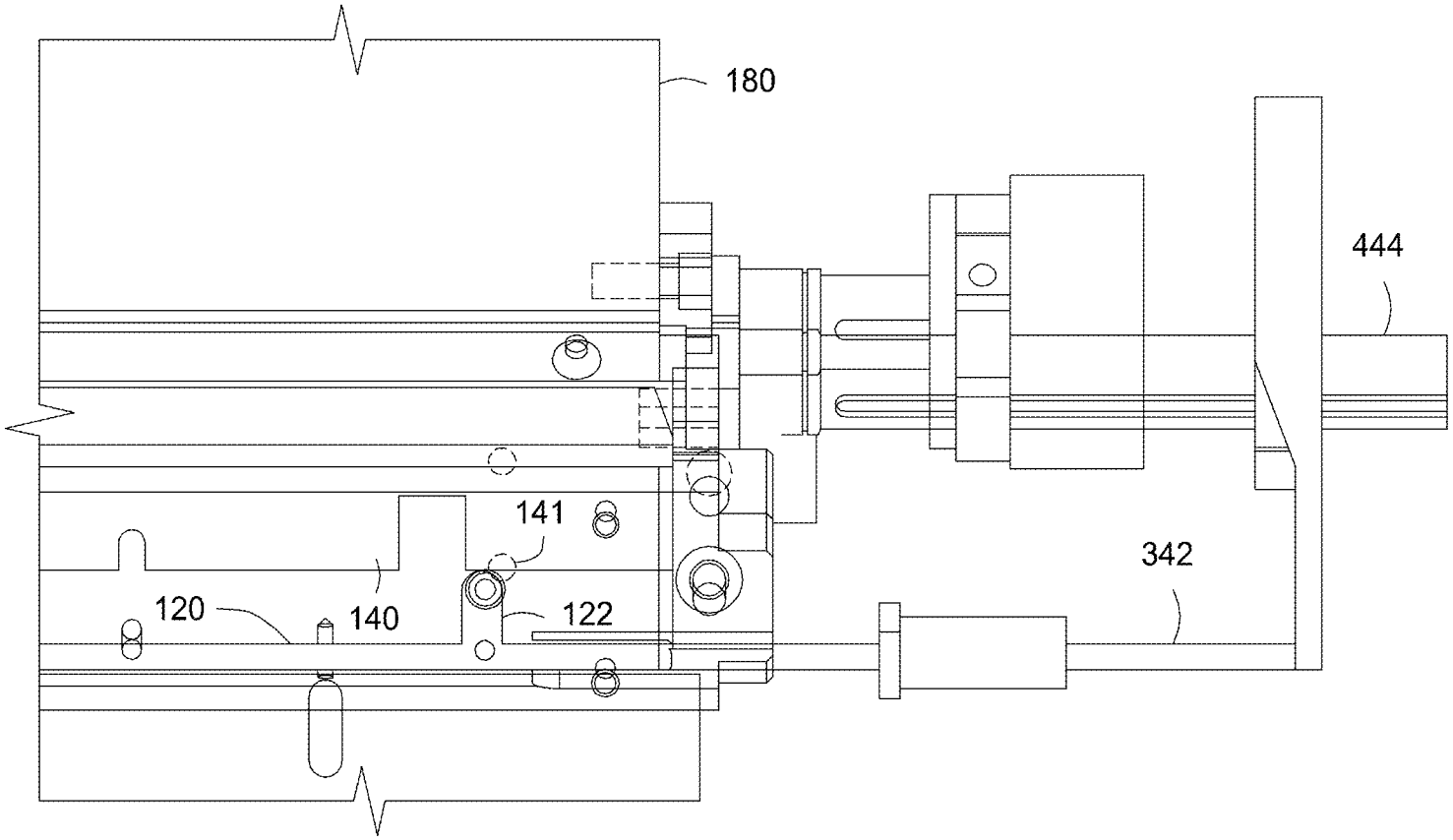
FIG. 2D is a top cross sectional view through the brake assembly of FIG. 2A.

At the moment shown in FIGS. 2A-2D, the angle foot 140 is held in its forward (closer to the bend bar 180) position firmly by engagement between chamfered bearing lobes 122 acting on the back side 141 of angle foot 140, which is best seen in FIG. 2D. These lobes 122 support the angle foot 140 against backwards pressure caused by the bend bar 180 as it rotates through the first 90 degrees of its rotation as the bend bar 180 bends the sheet metal 80.

As the main shaft 444 rotates further, as shown in FIGS. 3A-3E (the figures are labeled for their similar relationship to the FIGS. 2A-2D), the push rod cam 340 further rotates. As the push rod cam 340 further rotates, an angled surface 341 of the push rod cam 340 begins to act on a first end 344 of the push rod 342 driving the push rod 342 laterally. The lateral motion of the push rod 342 drives the second end 343 of the push rod 342 against end 123 of the backer bar 120, moving the backer bar 120 laterally along with the push rod 342.

Figure 3A:
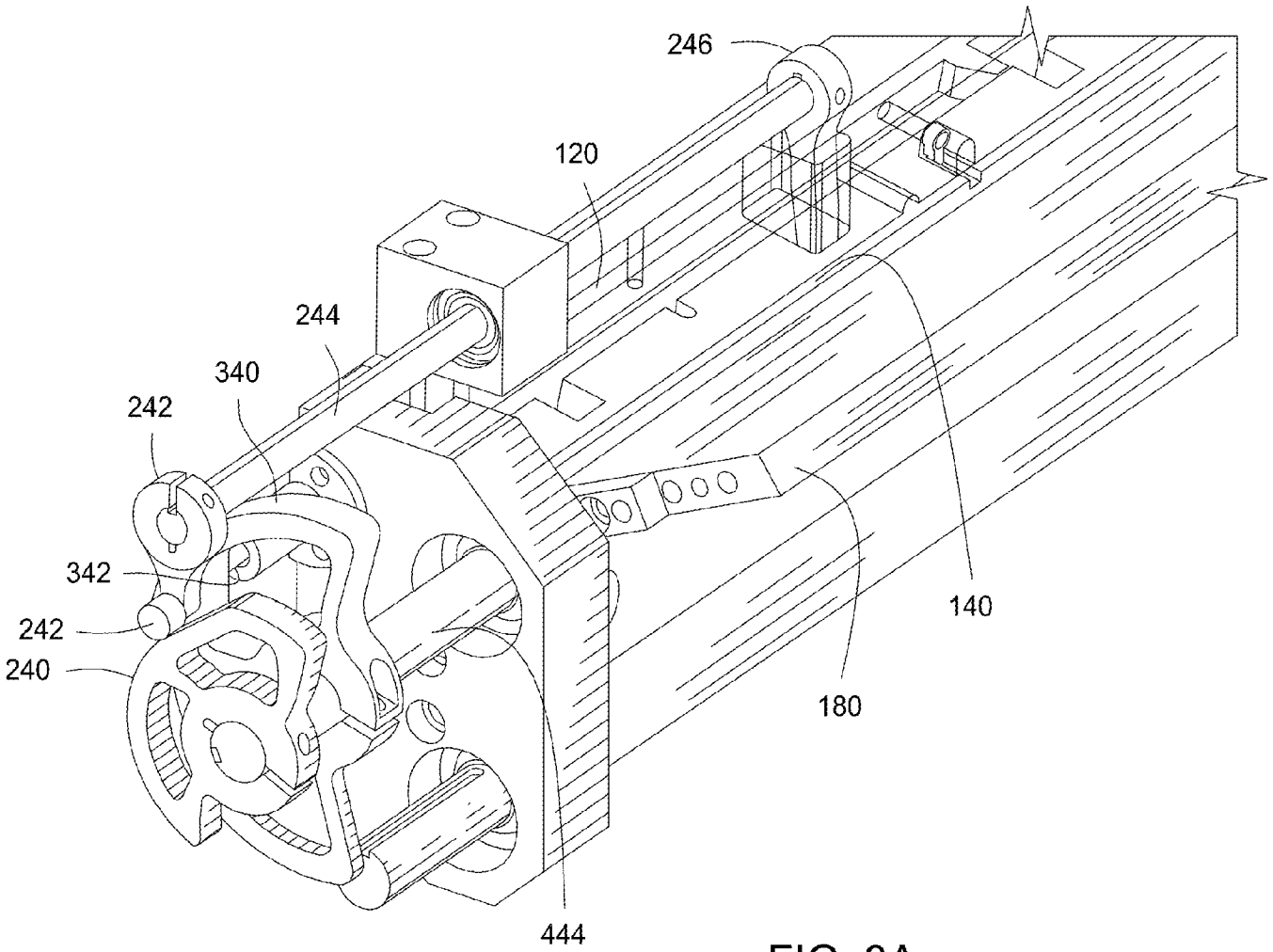
FIG. 3A is another isometric view of a brake assembly machine according to embodiments of the present invention.
Figure 3B:
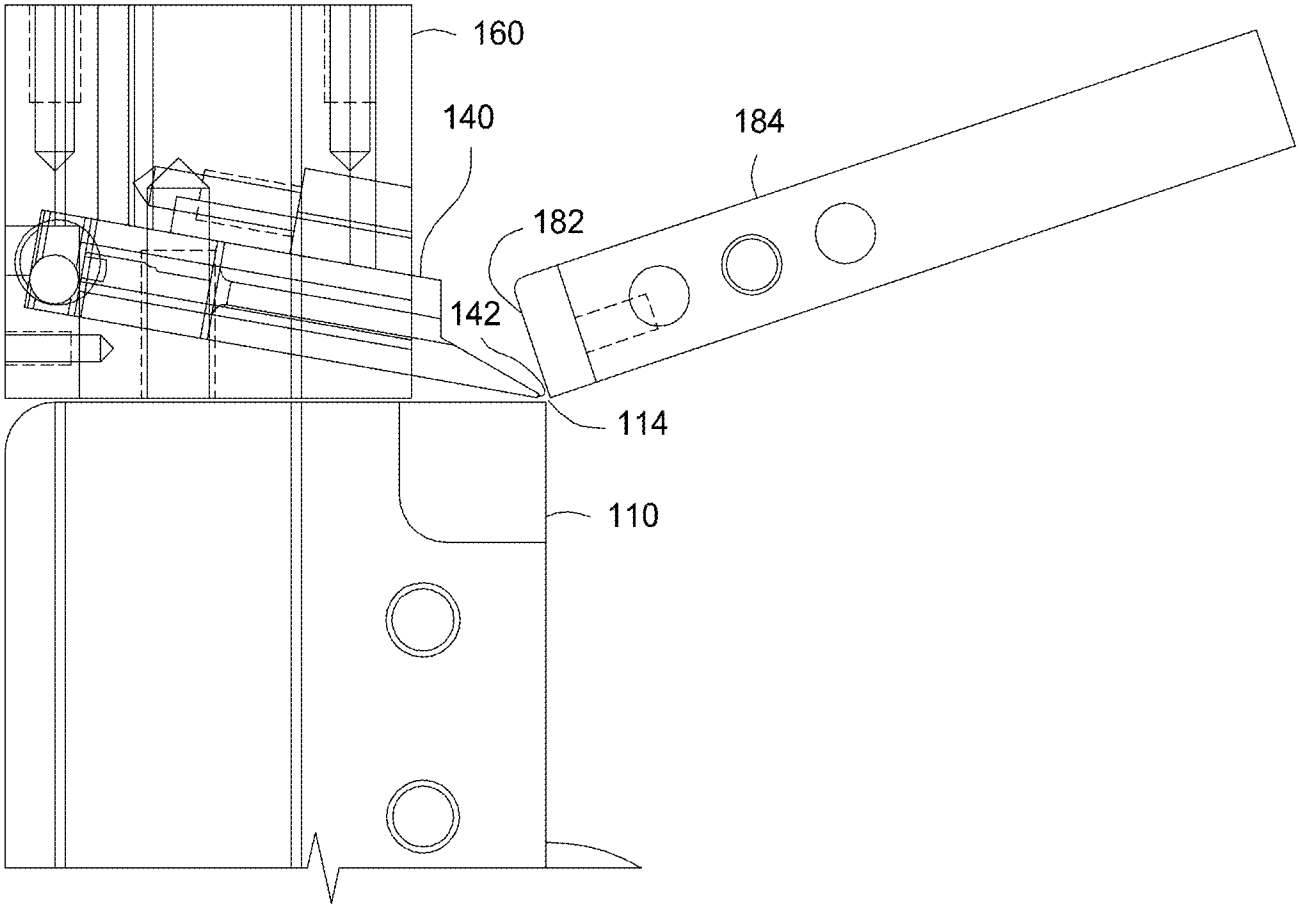
FIG. 3B is a side cross sectional view through the brake assembly of FIG. 3A.
Figure 3C:
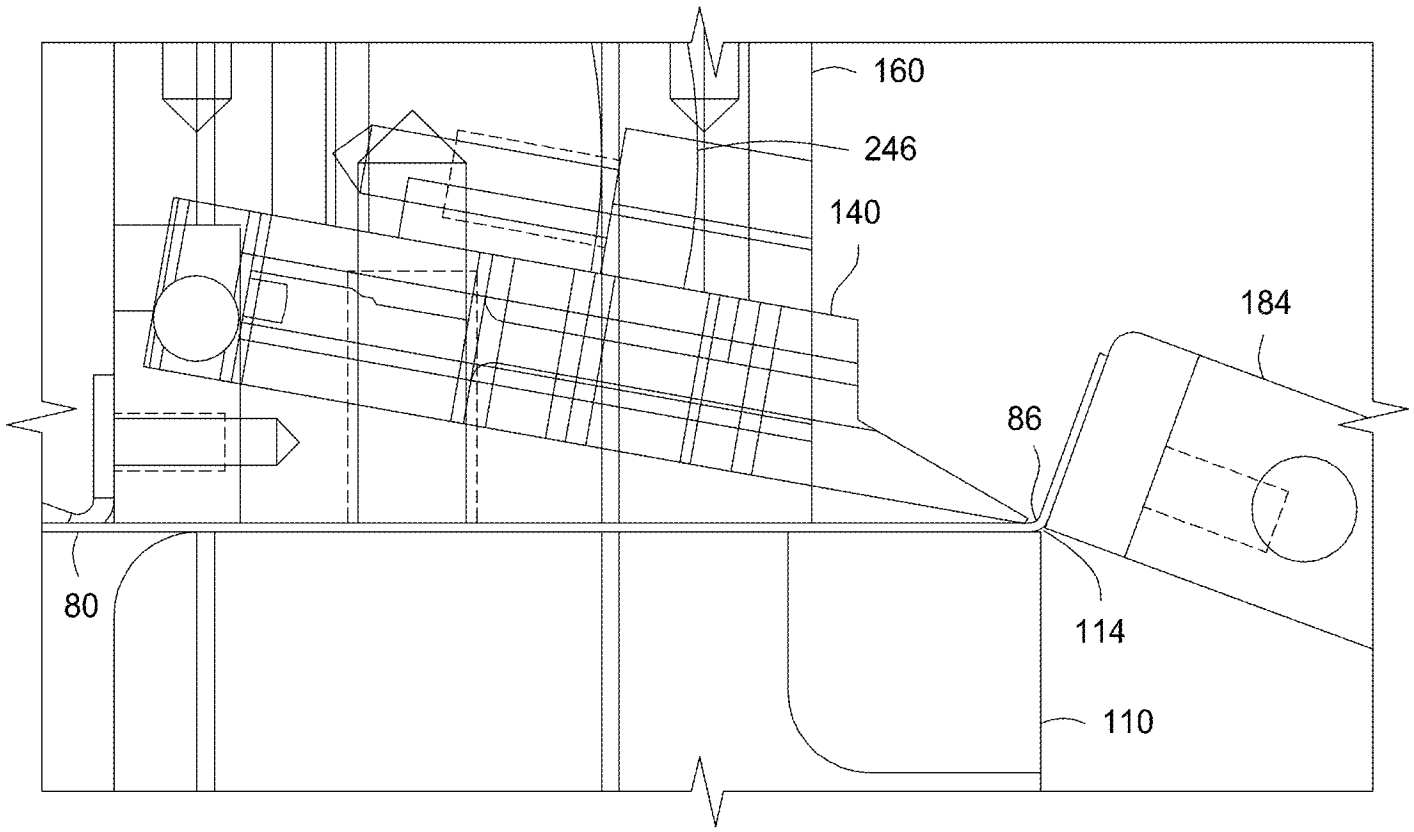
FIG. 3C is a side cross sectional view through the brake assembly of FIG. 3A showing sheet metal in the process of being formed into a hem.
Figure 3D:
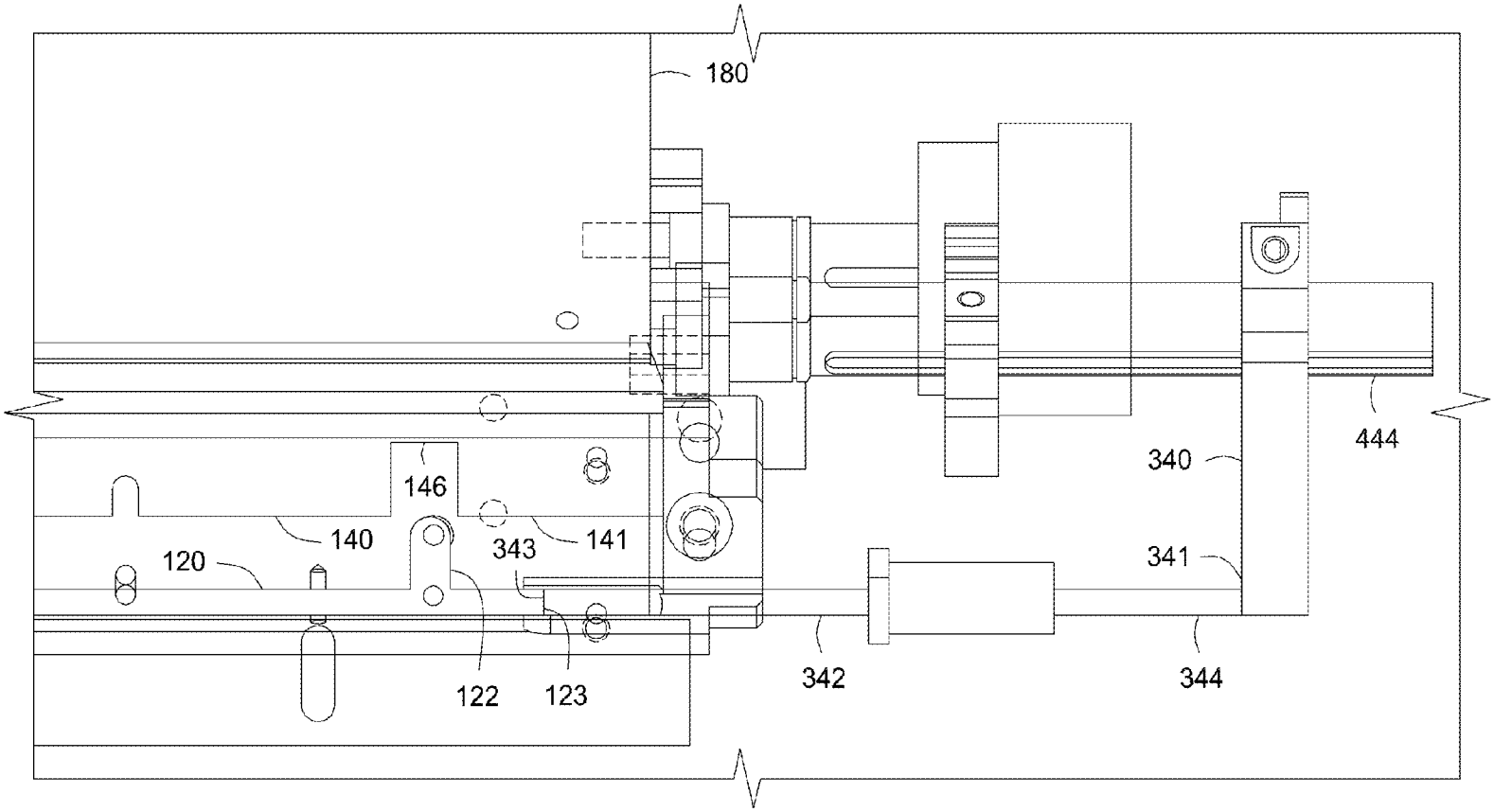
FIG. 3D is a top cross sectional view through the brake assembly of FIG. 3A.
Figure 3E:
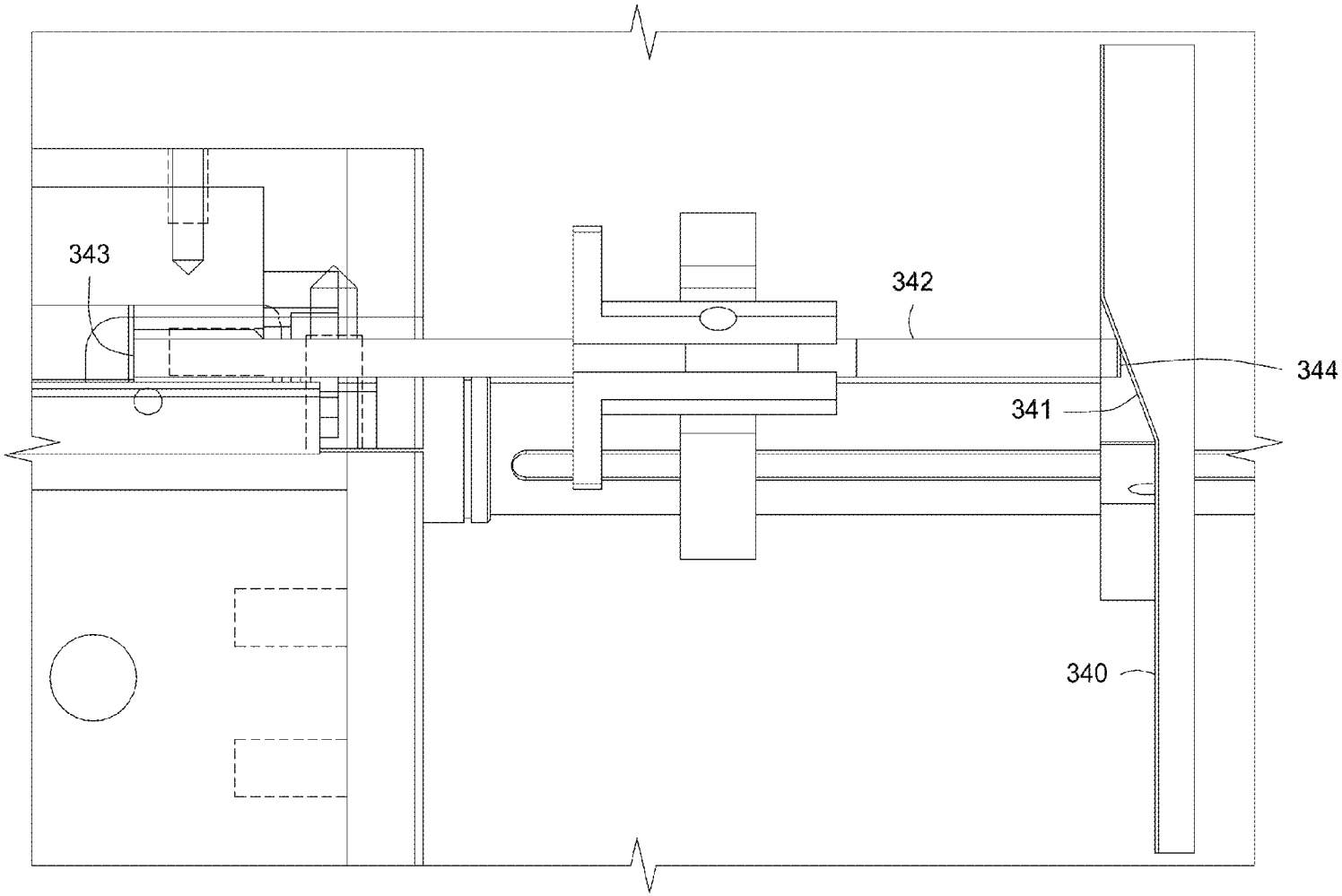
FIG. 3E is a bottom cross sectional view through the brake assembly of FIG. 3A.

During the lateral movement of the push rod 342 and backer bar 120, the lobes 122 disengage from the back side 141 of the angle foot 140, as best shown in FIG. 3D. With the lobes 122 disengaged, the angle foot 140 is not held as firmly in its forward position, and may move backwards as the lobes 122 engage within the angle foot slots 146. The withdrawal of the angle foot 140 becomes critical as the bend bar 180 continues its motion about the gap 114 and closes the hem 84.

Figure 4A:
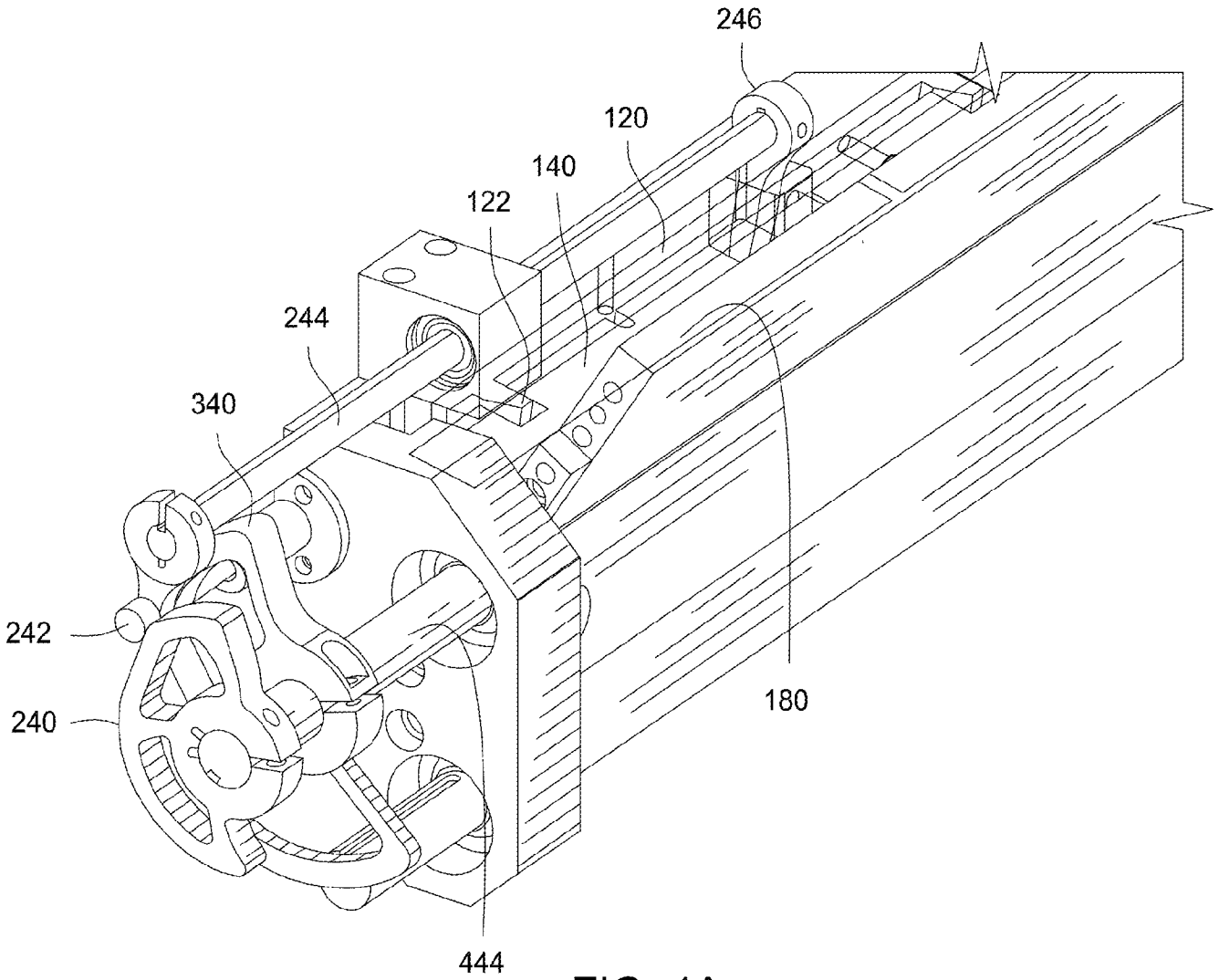
FIG. 4A is another isometric view of a brake assembly machine according to embodiments of the present invention.
Figure 4B:
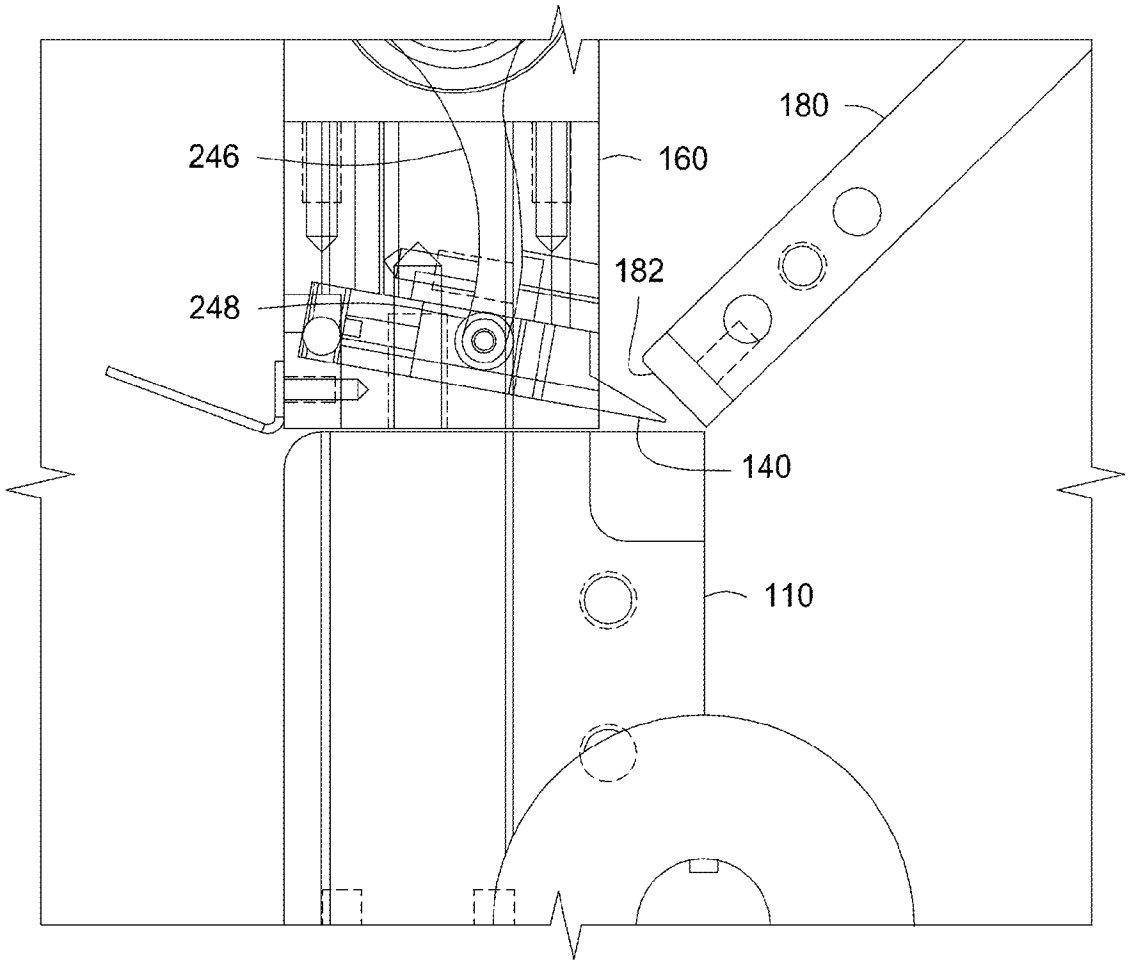
FIG. 4B is a side cross sectional view through the brake assembly of FIG. 4A.
Figure 5A:
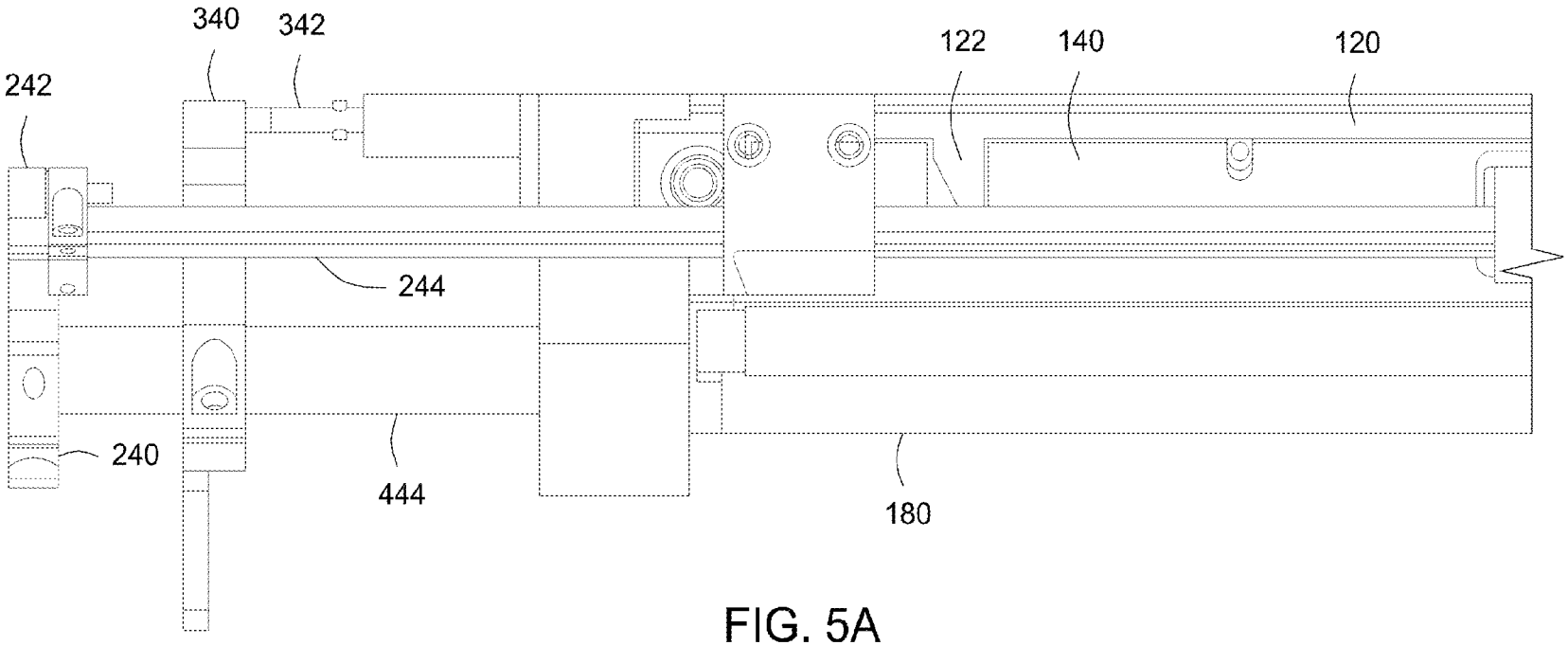
FIG. 5A is a top view of a brake assembly machine according to embodiments of the present invention.
Figure 5B:
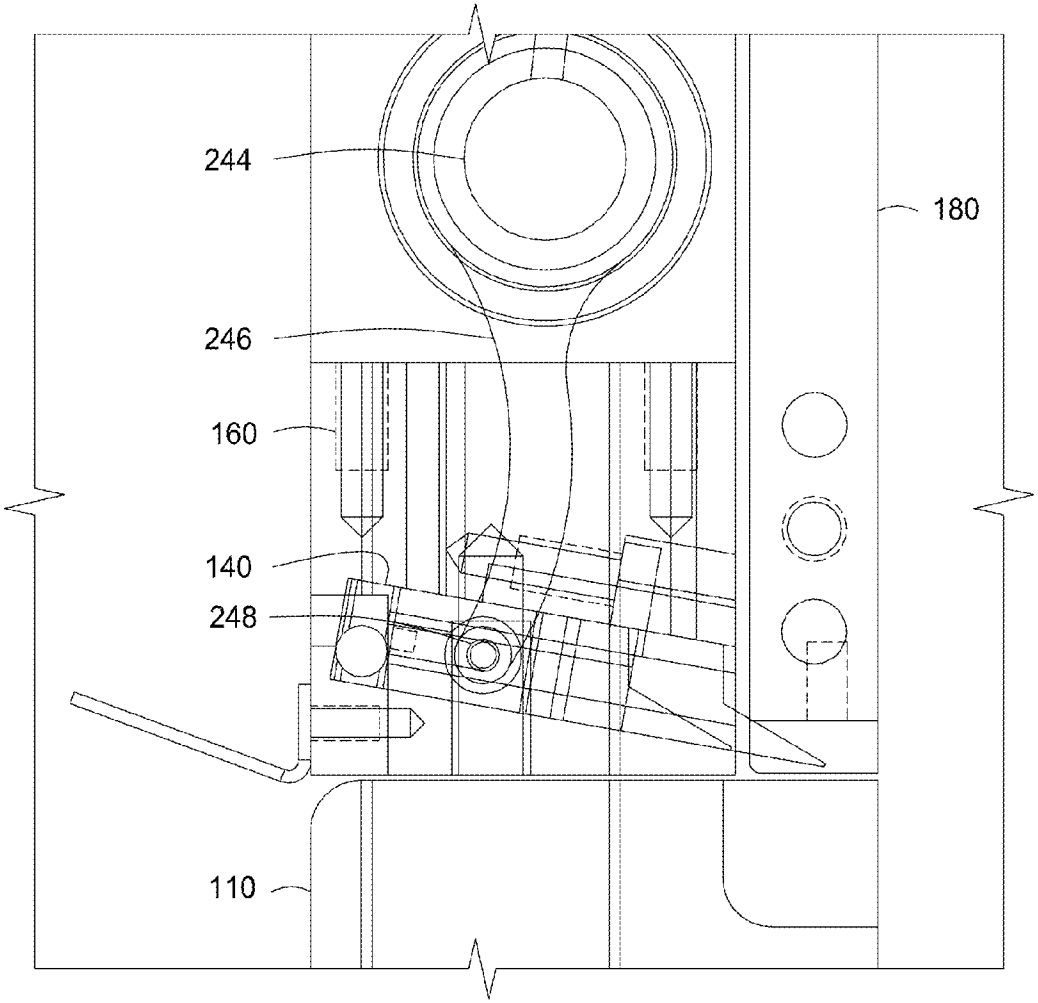
FIG. 5B is a side cross sectional view through the brake assembly of FIG. 5A.
Figure 5C:
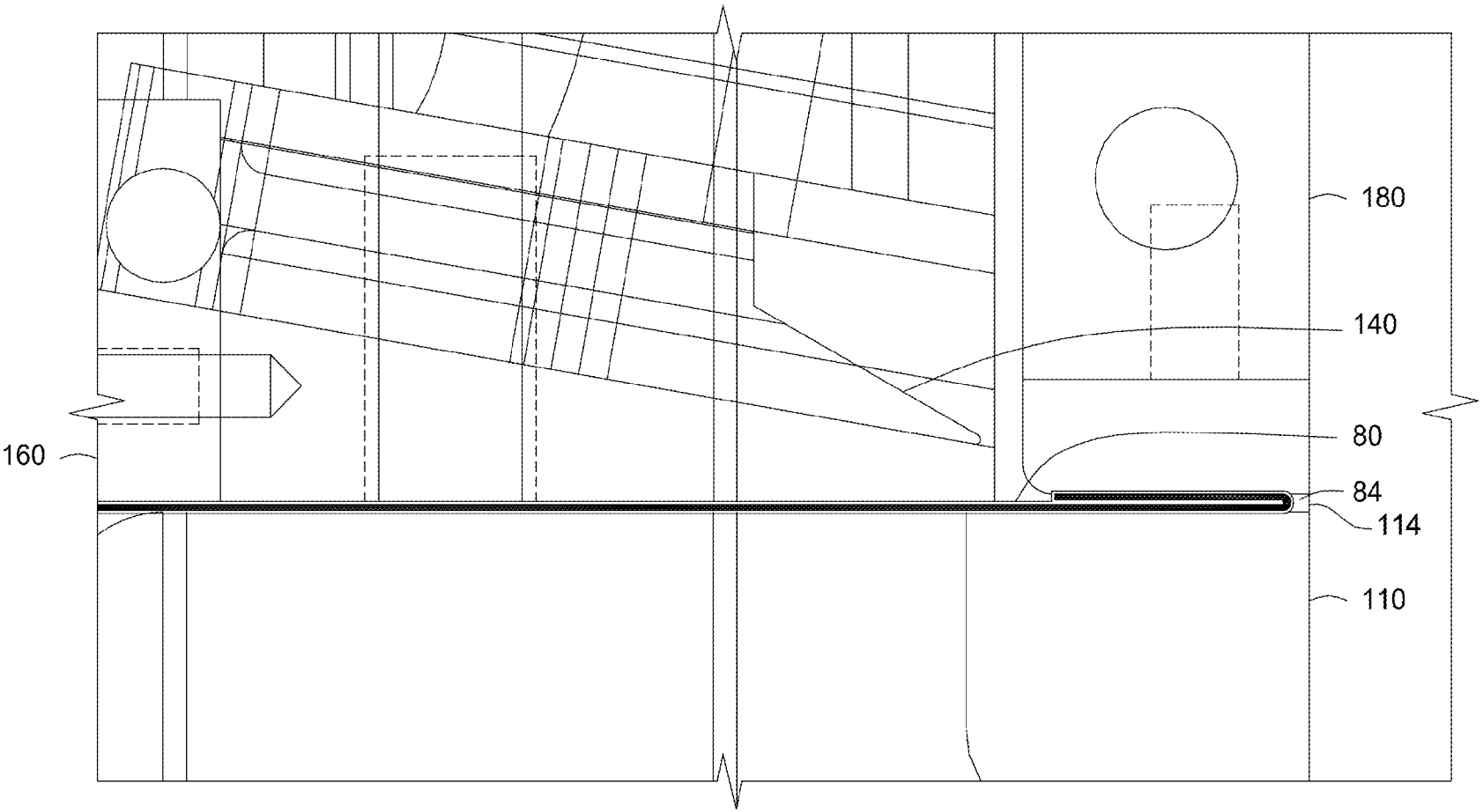
FIG. 5C is a side cross sectional view through the brake assembly of FIG. 5A showing sheet metal in the process of being formed into a hem.
Figure 5D:
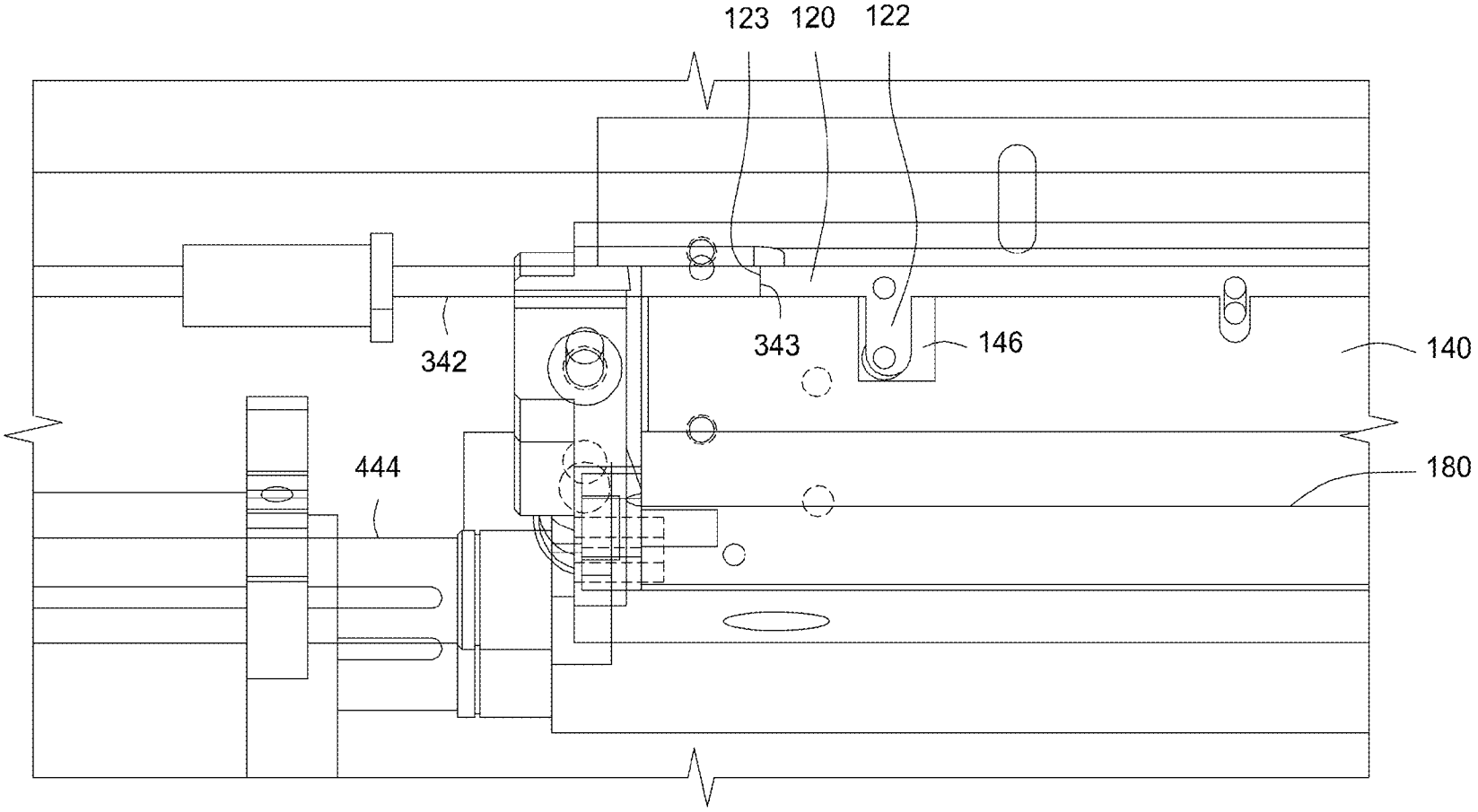
FIG. 5D is a top cross sectional view through the brake assembly of FIG. 5A.

FIGS. 4A and 4B show the ongoing closing motion of the bend bar 180 about gap 114 as the main shaft 444 continues its counterclockwise movement. As best seen in the "B" and "C" figures, and in the particular, FIG. 4B, the bending bar 180 would trap both the sheet metal 80 and angle foot 140 against the bottom bar 110 if the angle foot 140 does not retreat. The retreat of the angle foot 140 is important to close the hem 84 and also if the angle foot 140 did not withdraw, it would create damage to the entire assembly 100, which is of course undesirable.

Thus, the assembly machine 100 allows for completion of a hem 84 and prevents this potential damage by withdrawing the angle foot 140 up and back from the area where the hem 84 is being formed. In the assembly 100, this withdrawal is at an angle, although other withdrawal paths are possible. The assembly 100 accomplishes this withdrawal through the motion of the angle foot cam 240 acting on the cam follower 242. As the main shaft 444 turns, the angle foot cam 240 acts on the cam follower 242, turning the angle foot shaft 244. The clockwise movement (as illustrated) of the angle foot shaft 244 rotates the angle foot actuator 246. The angle foot actuator 246 engages the angle foot 140 at the angle foot actuator arm 248. Thus, the clockwise movement of the angle foot actuator 246 moves the actuator arm 248, which in turn moves the angle foot 140 along path formed in the assembly machine 100, drawing the angle foot 140 up and back, away from the closing face of the bend bar 180.

It should be appreciated at this point in the hem formation, the backwards pressure exerted on the sheet metal 80 is less than at the beginning of the motion of the bending bar 180 because as the bend bar 180 rotates, the force vector rotates with it. In FIGS. 2A-2D, the bending bar 180 exerts force backwards towards the angle foot 140, and thus, the angle foot 140 helps hold the sheet metal in place and oppose this backwards force. Once the bend bar 180 reaches the position shown in FIGS. 4A and 4B, the majority of the force that the bend bar 180 exerts is downwards, and the hold on the sheet metal between the top bar 160 and bottom bar 110 is adequate to prevent backwards movement in the sheet metal 80.

Prior art methods often involve forming a right angle in sheet metal and then withdrawing the sheet metal to set up a second step where the sheet metal is punched or crushed to form the hem.

FIGS. 5A-5D show the assembly machine 100 at the end of its hem forming cycle. At the point shown, the bending bar 180 has completed its rotation about the gap 114, and completely formed the hem 84 by pressing the sheet metal 80 onto itself between the bending bar 180 and bottom bar 110.

Figure 13:
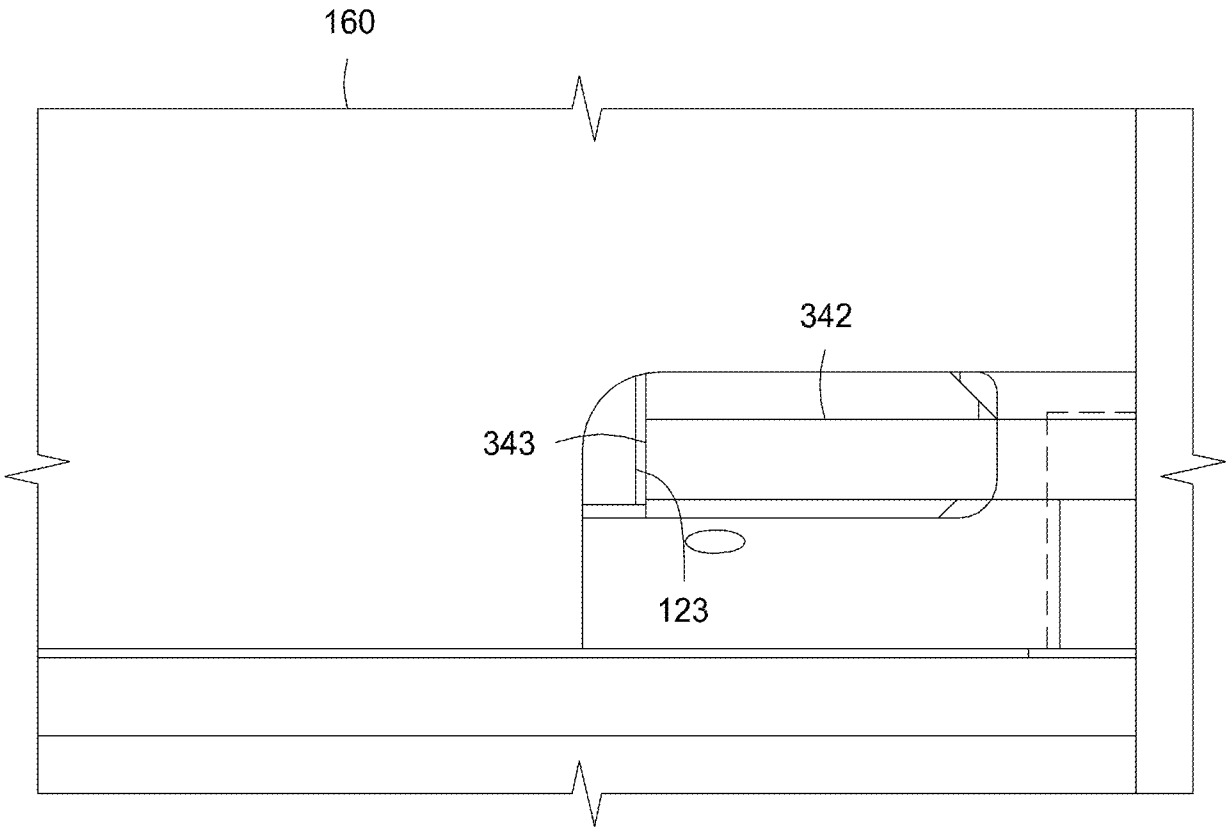
FIGS. 13 and 14 are cross sectional views of the push rod and backer bar engagement according to embodiments of the present invention.
Figure 14:
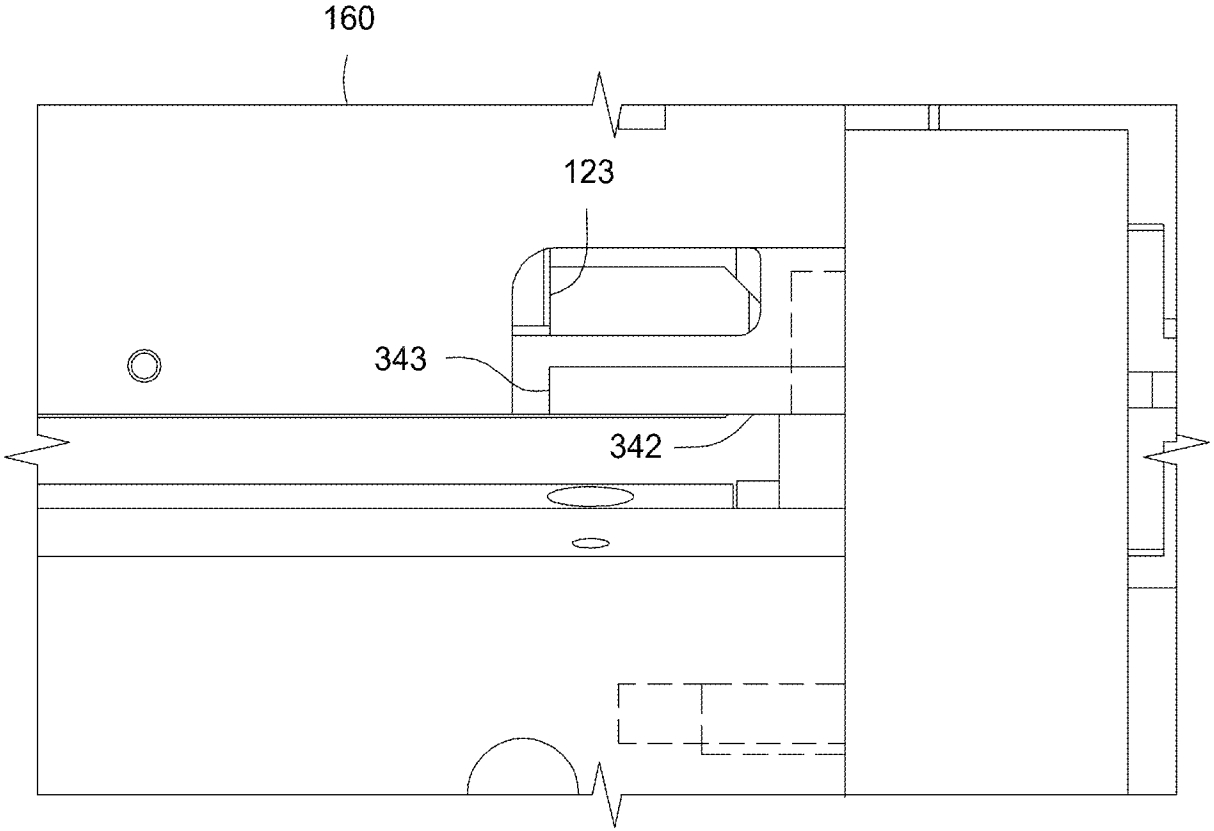

At this point in the hem-forming operation, the hem 84 has been formed, and the main shaft 444 rotates clockwise (as illustrated), reversing the motion of all of the parts that move under its influence, including moving the top bar 160 upwards and with it, the push rod 342, which thus disengages its end 343 from the backer bar end 123. This engagement to disengagement is most clearly seen between the engaged position shown in FIG. 13, and the disengaged position shown in FIG. 14. Once the bend bar bending face 182 is near a position that is level with the bottom bar 110, the top bar releases its hold on the sheet metal 80, and the metal is fed from the brake assembly machine 100.

FIG. 6 shows the brake assembly 100 within the automated cut and roll (ACR) machine 600. In the ACR machine 600, sheet metal is fed through a feed zone 602, and into the brake assembly 100 for processing as described above. As the sheet metal with the hem formed exits the brake assembly 100, it is pressed upwards at a predetermined angle between rollers 604. The rollers are located above the bottom bar 110 such that pressure exerted on the sheet metal uniformly bends it around the rollers, forming an open cylindrical shape in the sheet metal. This open cylindrical shaped sheet metal bends backwards on itself but is prevented from interfering with the brake assembly 100 by the capture plate 606. Once the sheet metal is formed to its desired circumferential length, it is cut by the ACR machine 600, and the next piece of sheet metal is processed.

FIGS. 6-12 show a brake assembly 700 with a similar operation to that described in FIGS. 2-5 but different as described hereafter. In the brake assembly 700, the cam for the push rod 340 is on the outside of the angle foot cam 740. The angle foot cam 740 turns through its connection to the main shaft 444 and acts upon the cam follower 742, which in turn operates the angle foot shaft 244. The remainder of the operation of the brake assembly 700 is similar to that described above.

It should be noted that FIG. 12 shows the motor 1210 that drives the brake assembly 100.

Although not shown, it should be understood that the next steps following the sheet metal 80 exiting the assembly machine 100 are a rolling operation wherein the sheet is formed into an open cylindrical roll shape by pressing the leading edge (in this case, hem 86) into a half or roughly three quarter open radial curved surface, where the force of the pressure exerted against the rear end of the sheet metal driving the hem against the curve forms the sheet metal 80 into a roll. Once the sheet metal is formed into a roll, the sheet metal 80 is cut to its desired length and the rolled sheet with the safety hem 86 can be processed further.

What is claimed is:

1. A brake assembly machine for forming a hem in sheet metal comprising:

a top bar;

a bottom bar opposite the top bar, wherein the top bar and the bottom bar are movable towards one another to hold the sheet metal therebetween;

a bending bar that includes a bending face rotatable about a bending bar axis;

an angle foot movable to a proximity of the bending bar in an extended position and movable away from the bending bar in a retracted position; and a common main shaft that is rotatable to drive the angle foot between the extended position and the retracted position and rotatable to impart movement of the bending bar;

wherein the angle foot is in the extended position as the bending bar and bending face begin rotation about the bending bar axis toward the bottom bar, and the angle foot is movable to the retracted position to avoid contact with the bending face prior to the bending bar completing rotation about the bending bar axis toward the bottom bar.

2. The brake assembly machine of claim 1, wherein rotation of the common main shaft is driven by a motor.

3. The brake assembly of claim 1, wherein the common main shaft drives an angle foot actuator that is engaged with the angle foot to move the angle foot between the extended and retracted positions.

4. The brake assembly of claim 3, wherein an angle foot cam attached to the common main shaft drives a cam follower that drives an angle foot shaft connected to the angle foot actuator.

5. The brake assembly machine of claim 1, further comprising a backer bar that inhibits the angle foot from moving to the retracted position when the backer bar is in a first position.

6. The brake assembly machine of claim 5, wherein the backer bar is movable to a second position where it does not inhibit the angle foot from moving to the retracted position.

7. A brake assembly machine for forming a hem in sheet metal comprising:

a top bar;

a bottom bar opposite the top bar, wherein the top bar and the bottom bar are movable towards one another to hold the sheet metal therebetween;

an angle foot movable to a proximity of a bending bar that includes a bending face;

a push rod that drives a backer bar to inhibit the angle foot from moving away from the bending face in a first position, and the push rod drives the backer bar to a second position where it does not inhibit the angle foot from moving away from the bending face;

wherein as the bending bar and bending face move about a bending bar axis and the bending face moves closer to the angle foot, the angle foot is movable to avoid contact with the bending bar; and wherein the push rod drives the backer bar transverse to the motion of the angle foot, disengaging lobes on the backer bar from a back side of the angle foot, allowing the lobes to engage slots in the angle foot as the angle foot moves to avoid contact with the bending bar.

8. The brake assembly machine of claim 7, wherein the push rod is driven by a push rod cam connected to a main shaft.

9. The brake assembly machine of claim 8, wherein the push rod cam is driven against the backer bar to disengage the backer bar from the angle foot by contact between an end of the push rod and a surface of the push rod cam.

10. The brake assembly machine of claim 9, wherein the push rod cam has an angled surface such that as the end of the push rod moves along the angled surface, the push rod moves transverse to the motion of the angle foot to push the backer bar until the backer bar lobes disengage from the back side of the angle foot.

11. A method for forming a hem in sheet metal using a brake assembly machine, the method comprising:

feeding the sheet metal into the brake assembly machine between a top bar and a bottom bar until an end of the sheet metal is on a bend surface of a bending bar;

securing the sheet metal between the top bar and the bottom bar;

rotating a common main shaft to drive an angle foot between an extended position and a retracted position and to rotate the bending bar and bending face;

driving the angle foot to a proximity of the bend surface in the extended position;

rotating the bending bar and bend surface about a bending bar axis that rotates the bend surface about the angle foot, wherein the rotation of the bending bar bends the sheet metal about the angle foot; and withdrawing the angle foot from proximity to the bend surface as the bend surface approaches the angle foot in the retracted position, wherein once the bending bar movement is complete, the sheet metal end has been bent onto itself to form the hem.

12. The method of claim 11, wherein the bending bar continues movement about the bending bar axis as the angle foot is withdrawn.

13. The method of claim 11, further comprising:

before withdrawing the angle foot from proximity to the bending bar, withdrawing a backer bar that inhibits the angle foot from being withdrawn.

14. The method of claim 13, wherein withdrawing the backer bar comprises moving the backer bar transversely with respect to the motion of the angle foot.

15. The method of claim 11, wherein once the hem is formed, the brake assembly machine releases the sheet metal.

16. The method of claim 15, wherein once released, the sheet metal is rolled to form an open cylinder shape.

17. The method of claim 15, wherein once released, the sheet metal is cut to a predetermined length.

18. The method of claim 11, further comprising removing the sheet metal with the hem formed thereon from the brake assembly machine.

19. An automated brake assembly machine for forming a hem in sheet metal comprising:

a top bar;

a bottom bar opposite the top bar, wherein the top bar and the bottom bar are movable towards one another to hold the sheet metal therebetween;

a bending bar that includes a bending face rotatable about a bending bar axis;

an angle foot movable to a proximity of the bending bar in an extended position and movable away from the bending bar in a retracted position;

a common main shaft that is rotatable to drive movement of both the angle foot and bending bar; and a motor that drives rotation of the common main shaft;

wherein the common main shaft drives the angle foot to the extended position and synchronously drives the bending bar and bending face to begin rotation about the bending bar axis toward the bottom bar, and the common main shaft drives the angle foot to the retracted position to avoid contact with the bending face prior to the bending bar completing rotation about the bending bar axis toward the bottom bar.

* * * * *